US007295418B2

(12) United States Patent
Vernitsky et al.

(10) Patent No.: US 7,295,418 B2
(45) Date of Patent: Nov. 13, 2007

(54) COLLIMATED IONIZER AND METHOD

(75) Inventors: Gregory Vernitsky, San Francisco, CA (US); Dennis Leri, Pleasant Hill, CA (US); Peter Gefter, South San Francisco, CA (US)

(73) Assignee: Ion Systems, Berkeley, CA (US)

( * ) Notice: Subject to any disclaimer, the term of this patent is extended or adjusted under 35 U.S.C. 154(b) by 39 days.

(21) Appl. No.: 11/037,408

(22) Filed: Jan. 18, 2005

(65) Prior Publication Data

US 2006/0158819 A1 Jul. 20, 2006

(51) Int. Cl.
*H01T 23/00* (2006.01)

(52) U.S. Cl. ..... 361/230; 96/60

(58) Field of Classification Search ..... 361/230; 96/60

See application file for complete search history.

(56) References Cited

U.S. PATENT DOCUMENTS 2,610,699 A * 9/1952 Penney et al. ..... 96/24
2,928,942 A * 3/1960 Wesley et al. ..... 361/231
4,657,483 A * 4/1987 Bede ..... 415/222
6,118,645 A * 9/2000 Partridge ..... 361/231
6,471,752 B1 * 10/2002 Lewis ..... 96/20
2003/0218855 A1 * 11/2003 Goldenberg ..... 361/213
2005/0270722 A1 * 12/2005 Gorczyca et al. ..... 361/230

* cited by examiner

*Primary Examiner*—Ronald W. Leja
(74) *Attorney, Agent, or Firm*—Fenwick & West LLP

(57) ABSTRACT

An air ion collimator is added to ionizers with integrated fans that are used to remove static charge. Three mechanisms minimize air ion losses through recombination. Hence, the collimator increases the air ions that are available for charge removal. First, reducing turbulence slows air ion mixing. Second, air entrainment into fast moving air ion zones further slows the rate of air ion losses by dilution. The rate of recombination reaction slows with decreasing ion density. Third, vanes within the collimator delay mixing. In addition to conserving air ions, the collimator directs more ions to the target. Air ions lost to grounding are reduced. Again, more air ions are available to remove static charge from the target.

14 Claims, 7 Drawing Sheets

Figure 7

Discharge Time (in Seconds) From 1000 Volts to 50 Volts Versus Height, Number of Vanes, and Number of Fan Blades

| Height (in Diameters) | Number of Vanes | Number of Fan Blades | | |
|---|---|---|---|---|
| | | 7 | 5 | 3 |
| No Collimator | | 4.05 | 4.05 | 4.05 |
| 1/4 | 3 | 3.68 | 3.16 | 3.80 |
| 1/4 | 6 | 2.52 | 2.44 | 2.93 |
| 1/4 | 12 | 2.47 | 2.31 | 2.75 |
| 1/2 | 6 | 2.22 | 2.07 | 2.67 |
| 1/2 | 12 | 2.65 | 2.23 | 2.85 |

COLLIMATED IONIZER AND METHOD

CROSS-REFERENCE TO RELATED APPLICATIONS

Not Applicable

STATEMENT REGARDING FEDERALLY SPONSORED RESEARCH

Not Applicable

REFERENCE TO A MICROFICHE APPENDIX

Not Applicable

BACKGROUND OF THE INVENTION

1. Field of the Invention

This invention relates to ionizers, which are designed to remove or minimize static charge accumulation. Ionizers remove static charge by generating air ions and delivering those ions to a charged target. This invention uses a collimator in combination with ionizer fans to improve the effectiveness of ion delivery to the target.

2. Description of Related Art

Ionizers remove static charge by ionizing air molecules, and delivering those generated air ions to a charged target. The air ions are typically created by high voltage applied to emitter tips, by nuclear disintegration, or by ionizing radiation. The location wherein the air ions are created is referred to as the source of air ions. Positive air ions neutralize negative static charges, and negative air ions neutralize positive static charges. Delivering the ions to the target is a major factor in overall ionizer effectiveness since air ions are lost during the transport time. Air ion losses explain why static charge removal may occur in a fraction of a second at close distances from the ionizer, yet require 30 seconds at large distances. There are two primary mechanisms responsible for air ion loss: recombination and grounding.

Recombination occurs when positive air ions collide with negative air ions. The products are two neutral air molecules that have no capability to remove static charge. Recombination is a function of air ion density and transport time. Higher air ion density increases the recombination rate, and more transport time increases the period over which that recombination rate operates.

Grounding occurs when ions contact a grounded surface. This happens when ions are delivered into a large area containing a small target of interest. Only those air ions directed to the small target are useful. Those air ions delivered outside the target circumference miss the target, and are eventually grounded. Hence, they performed no useful work.

A partial solution to reduce recombination and grounding is to employ fans in the ionizer. This solution is prior art, and commercial products are available. The fan provides a stream of fast moving air that carries the ions toward the target. Recombination is reduced because ions are diluted into the airflow of the fan. That is, air ion density is reduced by additional air, and reduced air ion density leads to a lower recombination rate. Also, transport time is reduced because the air ions are blown toward the target by the fan's average velocity.

However, fans by themselves miss the opportunity for even better ionizer performance. Without modification, fans introduce problems that limit the available benefit.

For example, fans produce turbulent air, not smooth laminar air. Turbulent air creates mixing, and mixing increases the rate of recombination. It is a generally known principle of chemistry that mixing or stirring increases the speed of reaction. More ions would be available for static charge removal if the turbulence could be reduced.

Ionizers with fans also produce a wide conical profile of ions moving toward the target. Hence, many of the generated ions are blown outside the target, and are eventually grounded. In essence, these ions are wasted.

Unmodified fans do not make use of inherent high velocity zones. Fan blades create the highest velocity in the outer ⅓ of the fan's radius. Fan blades are typically wider at the circumference than at the motor hub connection. So, there is more surface area imparting momentum to the air. The outside of the blade also moves faster than the inside. Again, more momentum is supplied to the air from the outside of the blade. If air ions could be maintained in the high flow zones, they would move faster toward the target, and air ion recombination would be minimized. Unfortunately, the high flow zones in unmodified fans quickly degenerate into turbulence. Also, these high flow zones tend to blow ions outward rather than straight at the target.

If the fan's high velocity zone is maintained, air entrainment occurs. Bernoulli's model describes this phenomenon. Fast moving air has lower pressure than surrounding still air. So, the still air of the environment is pulled into the fast moving air. More air means more dilution of the ions. As the density of the air ions decreases, recombination decreases. As noted previously, unmodified fans do not maintain a high velocity zone.

Fans without modification do not provide a mechanism to delay the mixing of positive and negative ions. Fans possess no barriers that can briefly separate positive and negative ions. Yet the ability to briefly separate positive and negative ions is known to decrease recombination loses. This fact is evident from the behavior of pulsed DC ionizers. Low pulse frequencies deliver more useful ions to the target than high pulse frequencies because mixing is delayed.

BRIEF SUMMARY OF THE INVENTION

The present invention improves the performance of ionizers with integrated fans by adding an ion collimator. Addition of the ion collimator increases ionizer performance by delivering generated ions more effectively. The increased performance results from decreasing air ion recombination losses and focusing the air ions directly upon the target of interest.

The collimator is a hollow outer shell, typically cylindrical, with straightening vanes contained within the hollow outer shell. The collimator can also be viewed as an ensemble of holes, hollow spaces, channels, or compartments which are formed by the combination of a hollow outer shell and segmenting vanes. These holes, hollow spaces, channels, or compartments are distributed around a central axis. The inlet side of the collimator fits downwind of an ionizer fan. The exit of the collimator faces the target. Generated air ions are delivered through the collimator.

Objects of the invention include (1) delivering the majority of ions to the target of interest, (2) minimizing ions which miss the target and are lost to grounding, and (3) minimizing air ion losses by recombination.

Objects of the invention are realized by reducing turbulence, delaying the mixing of ions, reducing outward ion flow paths, and introducing air entrainment.

BRIEF DESCRIPTION OF THE SEVERAL VIEWS OF THE DRAWINGS

FIG. 7 is a table of experimental data, which shows lower discharge times when a collimator is used. The effect of design parameters is also shown.

DETAILED DESCRIPTION OF THE INVENTION

Figure 1:
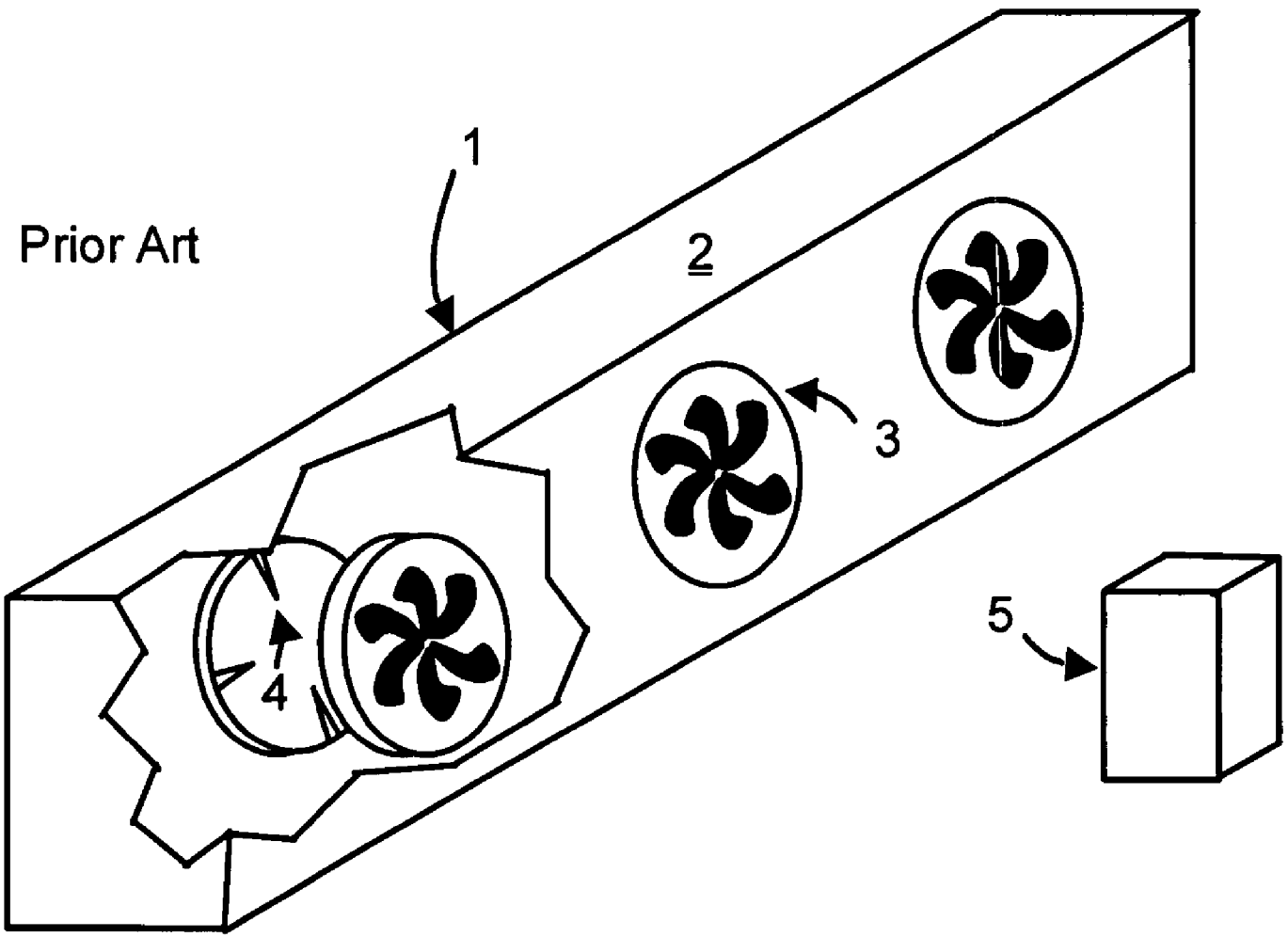
Figure 1 Prior Art
FIG. 1 is a pictorial illustration of an ionizer with fans, showing corona ion generation components through the left/top cut-away.

FIG. 1 shows a prior art ionizer with fans 1. Inside the chassis 2, air ions are created by high voltage applied to the corona electrodes 4. A fan 3 pulls the ions from the corona electrodes 4, and blows them toward a target 5. This ionizer with fans incorporated is a significant improvement over ionizers without fans. Static charge can be removed within practical time periods at large distances when the fans are incorporated. For example, a 20 nanoCoulomb charge 30 inches from the ionizer with fans is typically reduced to 2 nanoCoulombs within 5 seconds. Without the fans, the same charge removal depends on room air currents and may require more than 30 seconds.

Figure 2:
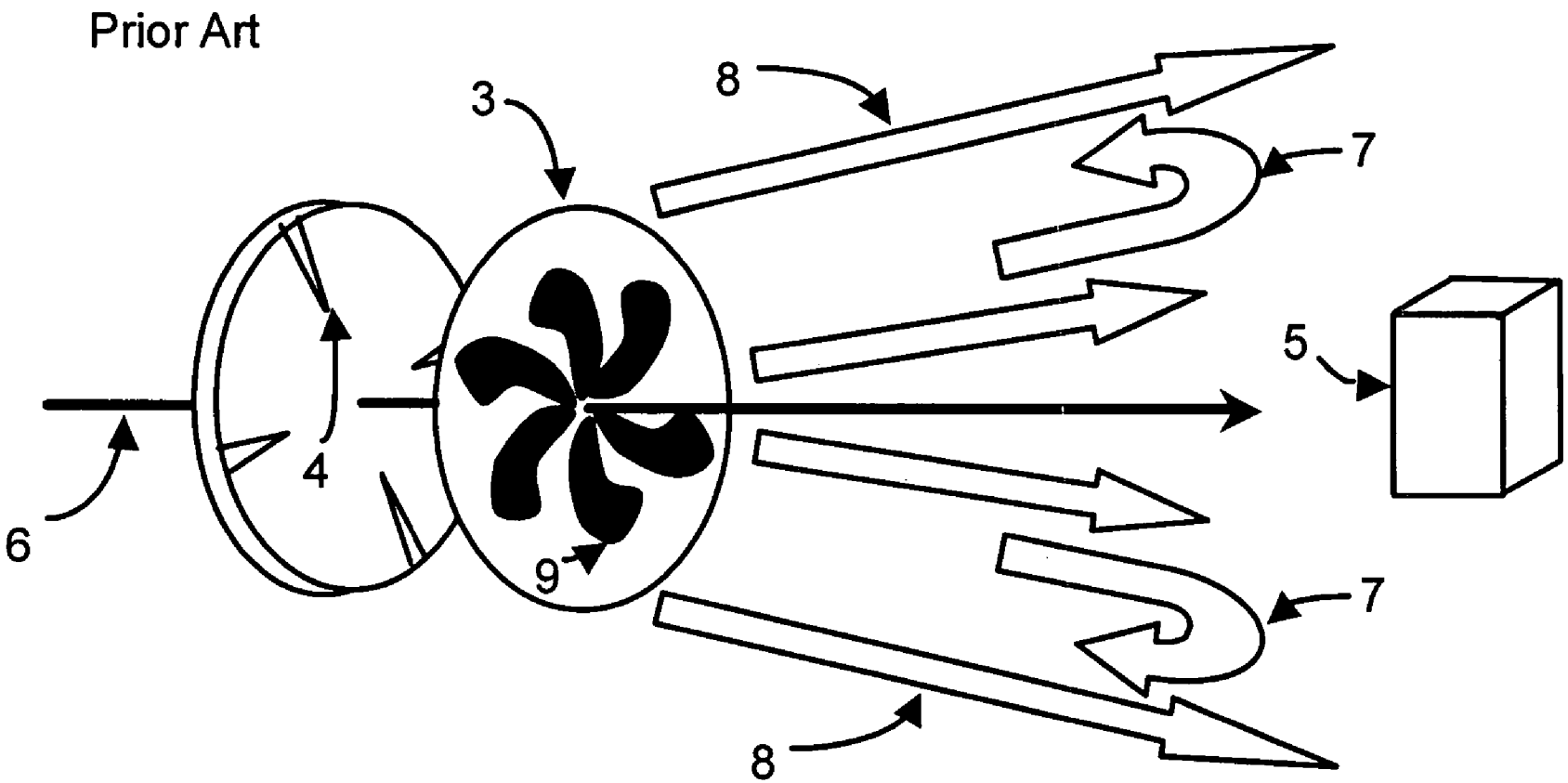
Figure 2 Prior Art
FIG. 2 is a pictorial illustration of the airflow produced by a prior art system.

However, the use of fans does not give the optimal charge removal performance. Fans introduce problems of their own as shown in FIG. 2. For example, although the axial flow line 6 is pointed toward the target 5, turbulence 7 facilitates the loss of air ions by mixing and recombination. In addition, air ions caught in reverse flows experience increased transport times, which further facilitates the loss of air ions by recombination.

Fans also propel the some of the air ions outward from the axial flow line 6. The ion delivery distribution has the form of a cone, which is narrow at the fan and wide at the target. These outward flow paths 8 miss the target 5. Hence, the air ions within these outward flow paths 8 are lost, and do not remove static charge from the target 5. Outward flow is particularly detrimental because the volume of air near the fan's circumference contains a disproportionately high level of ions. Note that the corona electrodes 4 are located immediately behind the fan's circumference. The fan blades 9 also create their highest velocity near the circumference.

Figure 3:
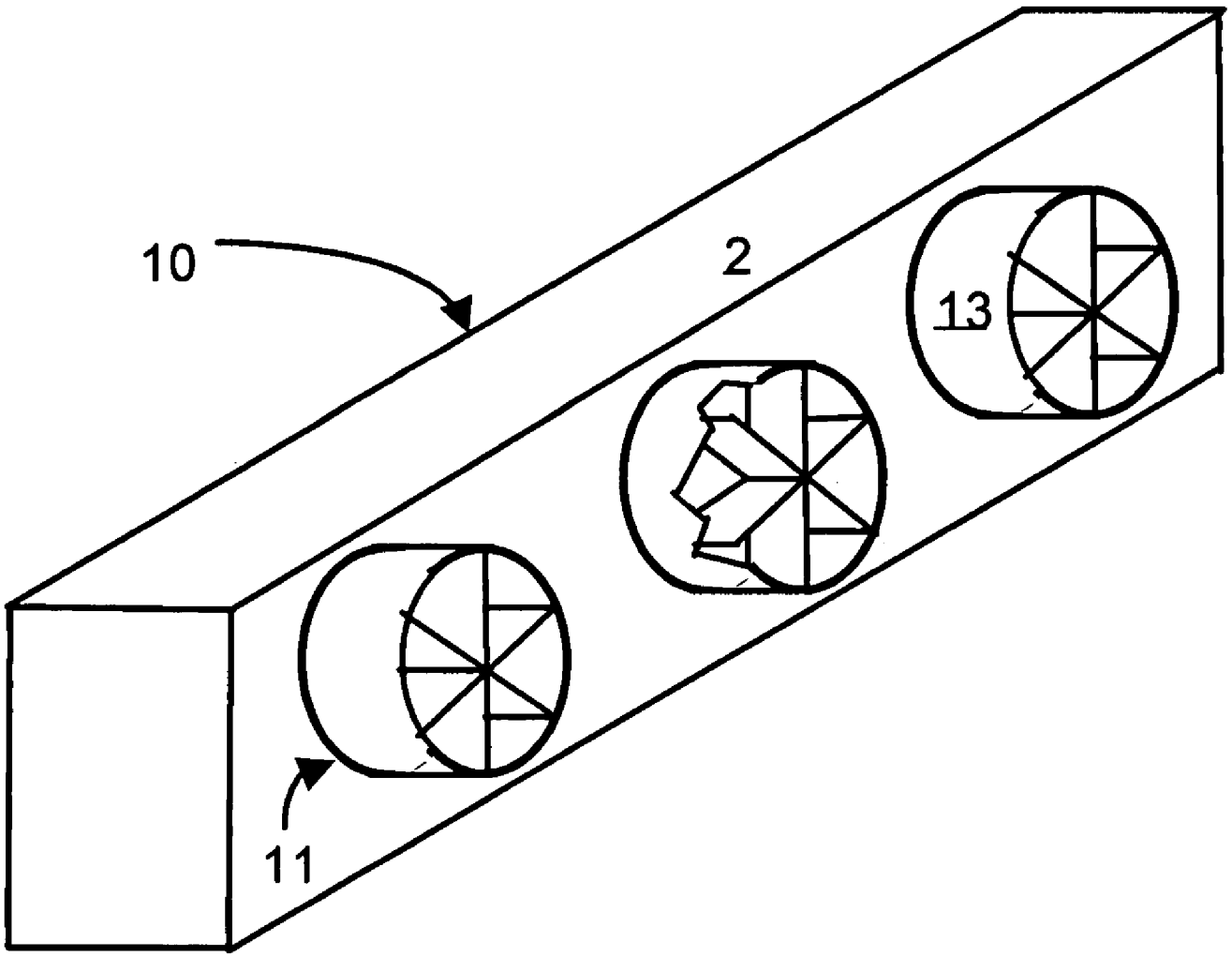
FIG. 3 is a pictorial illustration of an ionizer with fans, which has been modified with collimators. The middle collimator has been cut away on the left side.

FIG. 3 shows a preferred embodiment of a collimated ionizer 10. An ionizer with fans has been modified by the addition of a collimator 11 onto each fan. In practice, any individual fan or combination of fans may be modified. The fans are directly behind the collimators. For clarity, the center collimator is cut away. In this instance, the collimator's outer shell 13 is cylindrical. Other geometrical shapes are also acceptable for the collimator's outer shell, providing that a hollow tunnel is formed. For example, the cross sectional area may be a polygon, a polygon with rounded corners, an ellipse, or a circle. The collimator 11 may be symmetrically or asymmetrically positioned around the axial flow line 6.

Figure 4:
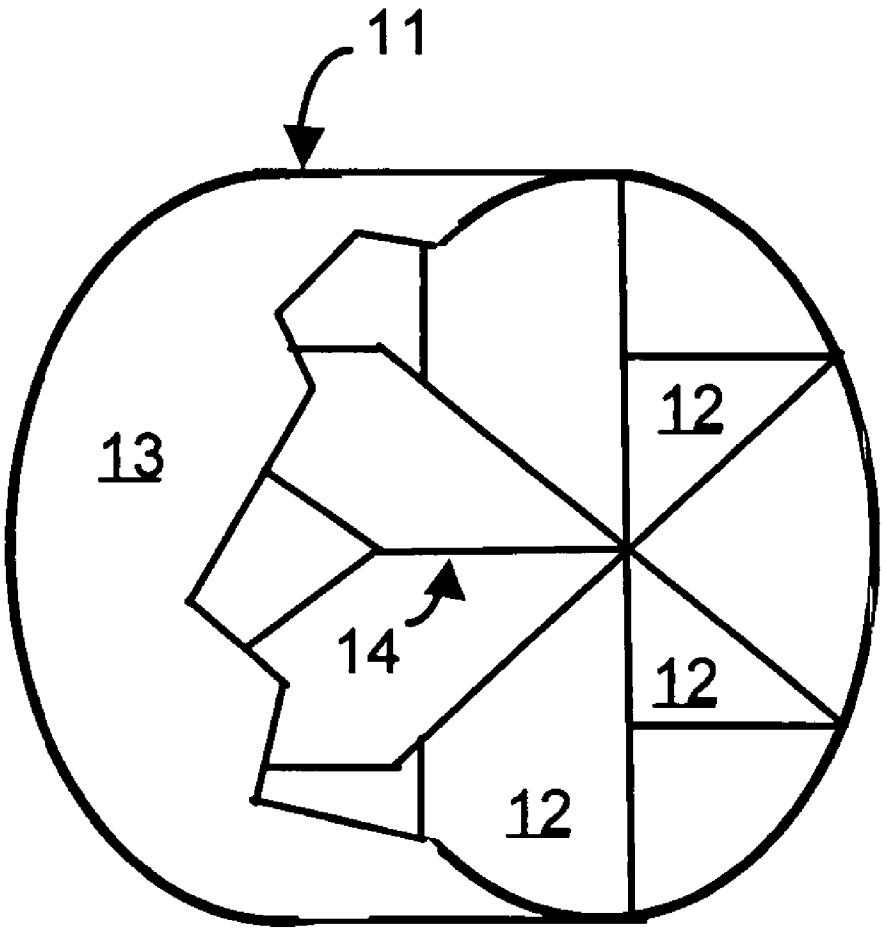
FIG. 4 is a pictorial illustration showing a collimator by itself. The left side is cut away.

FIG. 4 illustrates a collimator 11 that is not attached to an ionizer. The left side of the collimator's outer shell 13 has been cut away to expose the vanes 12. In this example there are six vanes, but anywhere between 1 and 20 vanes are can produce an improvement over the prior art ionizers. In this example, each vane emanates from the collimator's central axis 14. Each vane terminates at the collimator's outer shell. The collimator is made by attaching vanes to the inside surface of the collimator's outer shell. Any common method of attachment is satisfactory. For example, the vanes could be attached with screws, glue, pins, or tracks. But attachment is not limited to these techniques. Alternately, molding or machining may be employed. Connection of the collimator to the ionizer fan may use flanges, collars, screws, glue, pins, or tracks. But connection is not limited to these connection methods.

The optimal discharge time for a collimated ionizer with fans varies with the number of emitters employed, the height of the collimator, the number of vanes, and the number of fan blades. FIG. 7 shows the effect of the height of the collimator, the number of vanes, and the number of fan blades. Low discharge times are desirable. Note that all table entries were normalized to an uncollimated discharge time of 4.05 seconds.

The plane of each vane may or may not contain the central axis of the collimator. Alternately stated, a plane which contains the collimator's central axis 14 is not necessarily parallel to the plane of any vane.

A two piece collimator is also possible. That is, the vanes may be separate from the collimator's outer shell. However, the single piece collimator described in, FIG. 4 remains the best mode currently contemplated.

No mechanical connection from the vanes to the central axis is required for alternate embodiments. However, the single piece collimator described in FIG. 4 remains the best mode currently contemplated.

The vanes 12 perform two main functions. First, they break up the angular momentum of air ions that are propelled by the fan. That is, the air ion profile is straightened, which reduces turbulence mixing and recombination. Second, the vanes delay air ion mixing until the exit of the collimator is reached. This further reduces recombination.

The collimator's outer shell 13 is useful to minimize outward flow paths 8 that result in wasted air ions. The optimal length of the collimator's outer shell varies with the application. The length of the collimator's outer shell is measured along the direction of the axial flow line 6. Longer lengths focus the ions into a smaller area. Smaller lengths focus the ions into a wider area. Practical outer shell lengths range from 0.1 diameters to 2.0 diameters. Where the perimeter is not cylindrical, the practical perimeter lengths are 0.1 diameters to 2.0 diameters of a circle whose area equals the cross sectional area of the collimator's outer shell.

Figure 5:
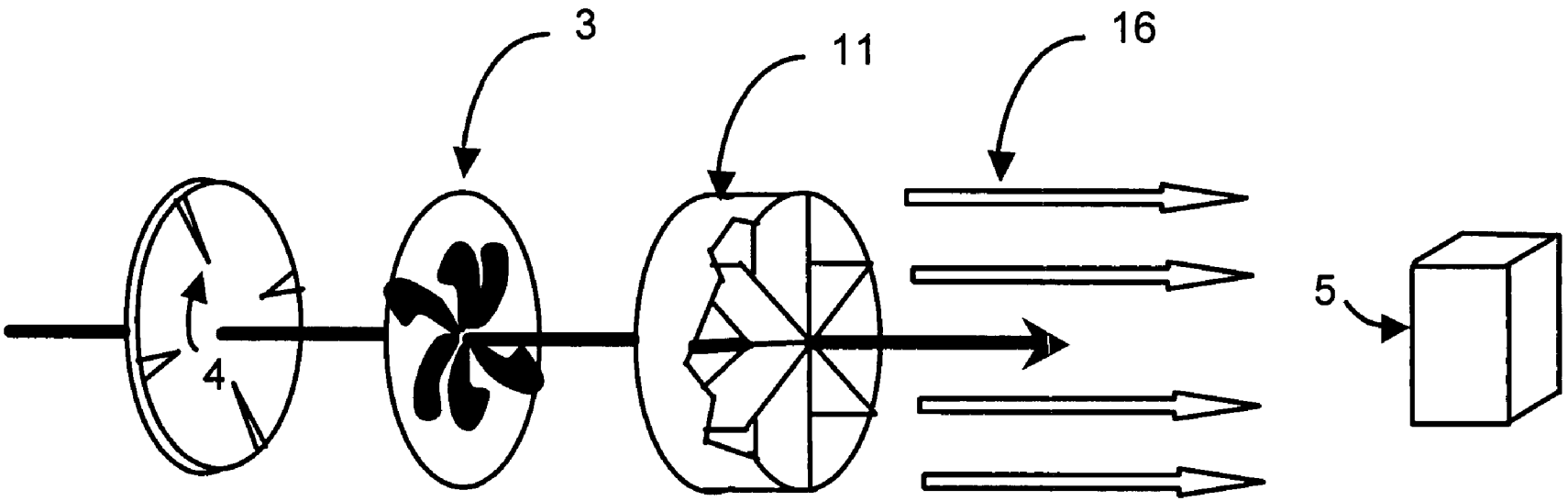
FIG. 5 is a pictorial illustration showing the direction of airflow from the ion source to the fan and through the collimator.

FIG. 5 shows how the active components are arranged. Air from the left side passes by the corona electrodes 4, where air ions are created. The fan 3 propels the air ions through the collimator 11 to the target 5.

In alternate embodiments, corona electrodes may also be positioned between the fan and the collimator. In this case, air flows from the fan toward the corona electrodes and then through the collimator. This still positions the collimator downwind of the source of air ions. However, FIG. 5 illustrates the best mode currently contemplated.

FIG. 5 also shows collimated flow paths 16 that result from the addition of a collimator to a prior art ionizer. Fewer air ions miss the target, compared to a non-collimated fan. And fewer ions are lost to recombination since the turbulence is less, compared to a non-collimated fan.

Figure 6:
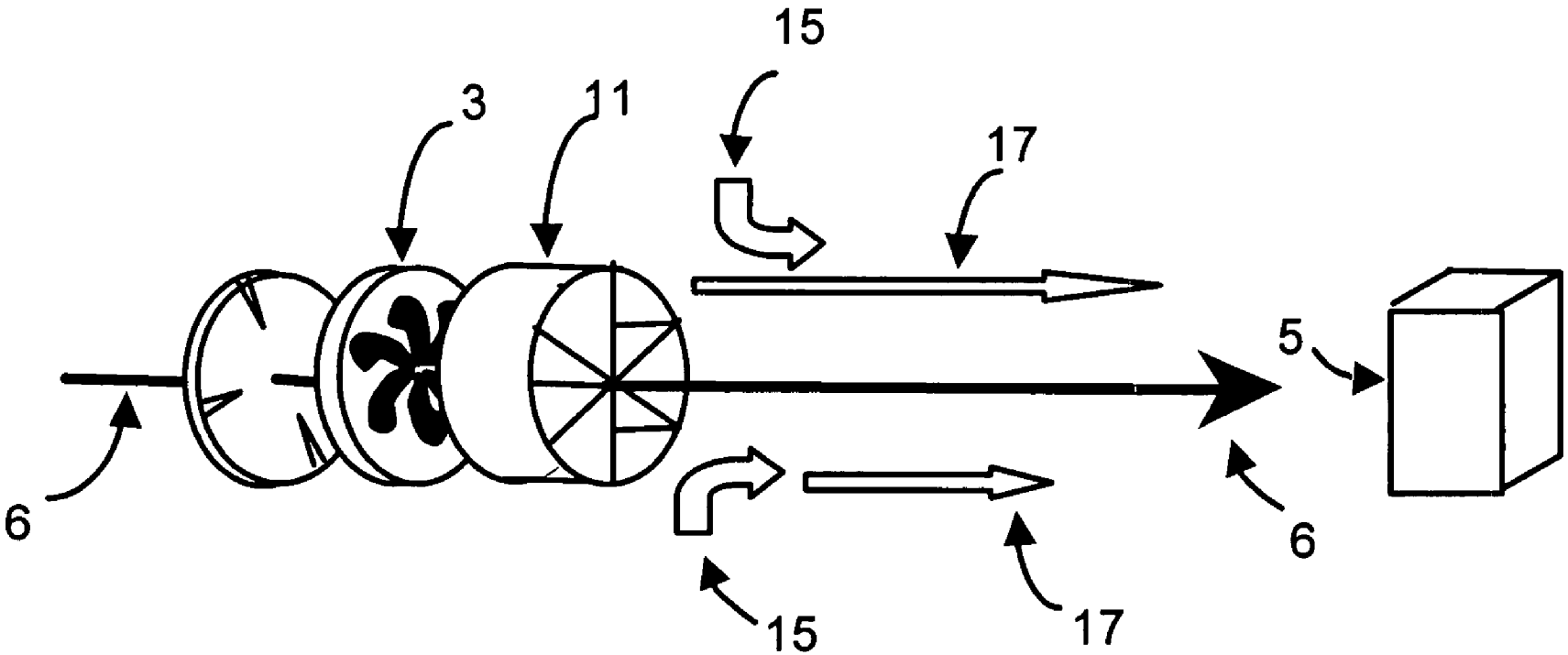
FIG. 6 is a pictorial illustration of air entrainment introduced by the current invention.

FIG. 6 shows air entrainment. The high velocity air flow 17 at the circumference of the collimator 11 has lower pressure than the surrounding room air. Hence, room air is entrained into the high velocity air flow 17 along the entrainment path 15. This high velocity air flow contains a disproportionately high concentration of air ions. Air entrainment results in air ion dilution. The recombination rate is reduced since the air ion density is reduced by the entrainment of additional air.

An ion collimator may be constructed from conductive, static dissipative, or insulative materials. Insulative material is used in the current best mode contemplated.

The invention claimed is:

1. Apparatus for generating air ions, the apparatus comprising:

a housing having an air inlet and an air outlet;

a fan within the housing including a plurality of blades rotatable about an axis for moving a stream of air from the inlet through the outlet in a direction substantially along the axis;

an air ionizer disposed within the housing intermediate the inlet and outlet for producing air ions within the stream of air flowing through the outlet; and an ion collimator disposed at the outlet in the stream of air flowing therethrough, the collimator including an outer shell dimensioned to confine the flow of air therethrough and including a plurality of vanes extending radially inwardly from the outer shell toward a central region thereof, the vanes each including a surface substantially oriented in the direction along the axis.

2. The apparatus according to claim 1 in which the collimator contains 2 to 20 vanes.

3. The apparatus according to claim 2 in which the collimator vanes comprise flat planes oriented radially outward from the central region.

4. The apparatus according to claim 2 in which the collimator vanes comprise curved surfaces oriented radially outward from the central region.

5. The apparatus according to collimated ionizer claim 2 in which the collimator contains 4 to 8 vanes.

6. The apparatus according to claim 1 in which the air ionizer includes a plurality of ionizer electrodes disposed within the housing between the air inlet and air outlet for producing air ions to flow in the air stream in response to ionizing voltage supplied thereto.

7. The apparatus according to claim 6 in which the plurality of ionizer electrodes are positioned upstream of the fan.

8. The apparatus according to claim 1 in which the vanes are substantially as long in the direction along the axis as the outer shell, with a length of approximately 0.1 to 2.0 times a diameter of the outer shell.

9. The apparatus according to claim 8 in which the length of the vanes is substantially 0.5 to 2.0 times the diameter of the outer shell.

10. The apparatus according to claim 1 in which the vanes and outer shell are formed of electrically insulating material.

11. The apparatus according to claim 1 in which the vanes and outer shell are formed of static dissipative material.

12. Apparatus for generating ions, the apparatus comprising:

means for moving a stream of air in a selected direction;

means for generating air ions in the moving stream;

means for collimating the stream of moving air including a confining channel and a plurality of vanes therein having surfaces disposed in the stream of air in substantial alignment with the selected direction and radially-oriented extending inwardly toward a central region of the channel within the stream of air for directing the stream of air flowing through the channel.

13. A method of neutralizing static charge on an object from a remote location, comprising the steps of:

forming at the remote location a stream of air moving toward the object; generating ions at the remote location in the air moving toward the object;

passing the stream of air and the ions therein through a confining channel disposed intermediate the remote location and the object and aligned with the stream of moving air, the channel including radially-oriented vanes extending inwardly toward a substantially central region of the moving air stream.

14. The method according to claim 13 in which the confining channel includes a plurality of sectors formed between vanes having radially-decreasing cross-sectional dimensions in directions extending substantially toward the central region.

* * * * *

UNITED STATES PATENT AND TRADEMARK OFFICE

CERTIFICATE OF CORRECTION

PATENT NO. : 7,295,418 B2
APPLICATION NO. : 11/037408
DATED : November 13, 2007
INVENTOR(S) : Gregory Vernitsky, Dennis Leri and Peter Gefter It is certified that error appears in the above-identified patent and that said Letters Patent is hereby corrected as shown below:

Column 5,
Line 44, please delete "collimated ionizer."

Signed and Sealed this

Twenty-ninth Day of April, 2008

JON W. DUDAS
*Director of the United States Patent and Trademark Office*